United States Patent [19]

Wood

[11] Patent Number: 4,629,403

[45] Date of Patent: Dec. 16, 1986

[54] ROTARY COMPRESSOR WITH VANE SLOT PRESSURE GROOVE

[75] Inventor: Mark W. Wood, Britton, Mich.

[73] Assignee: Tecumseh Products Company, Tecumseh, Mich.

[21] Appl. No.: 791,295

[22] Filed: Oct. 25, 1985

[51] Int. Cl.[4] ..... F04C 18/00; F04C 29/02; B23P 13/04

[52] U.S. Cl. ..... 418/1; 418/63; 418/94; 418/243; 29/156.4 R; 29/557

[58] Field of Search ..... 418/1, 63, 88, 94, 243–251; 29/156.4 R, 557

[56] References Cited

U.S. PATENT DOCUMENTS

| | | | |
|---|---|---|---|
| 2,153,371 | 4/1939 | Hubacker . | |
| 2,246,276 | 6/1941 | Davidson | 418/63 |
| 2,612,311 | 9/1952 | Warrick et al. | 418/63 |
| 2,623,365 | 12/1952 | Daniel | 62/117.7 |
| 2,721,026 | 10/1955 | Dills . | |
| 2,883,101 | 4/1959 | Kosfeld . | |
| 2,988,267 | 6/1961 | Kosfeld . | |
| 3,056,542 | 10/1962 | Galin . | |
| 3,082,937 | 3/1963 | Tucker . | |
| 3,208,667 | 9/1965 | Boettcher . | |
| 3,250,459 | 5/1966 | Brown et al. | 418/86 |
| 3,499,600 | 3/1970 | McGregor | 418/88 |
| 3,513,476 | 5/1970 | Monden et al. | 417/372 |
| 3,804,202 | 4/1974 | Funke | 184/6.16 |
| 3,813,193 | 5/1974 | Rinehart | 418/63 |
| 4,391,573 | 7/1983 | Tanaka et al. | 418/63 |

FOREIGN PATENT DOCUMENTS

| | | | |
|---|---|---|---|
| 20765 | 5/1956 | Fed. Rep. of Germany . | |
| 1379368 | 10/1964 | France . | |
| 59-170486 | 9/1984 | Japan | 418/63 |
| 300662 | 1/1973 | U.S.S.R. | 418/63 |

*Primary Examiner*—John J. Vrablik

*Attorney, Agent, or Firm*—Albert L. Jeffers; Anthony Niewyk

[57] ABSTRACT

A rotary hermetic compressor including a compressor cylinder having a bore therein, and a sliding vane slidably disposed in a slot in the compressor wall. The vane extends into the bore of the cylinder for cooperating with a roller to divide the compression chamber into a suction chamber and a discharge chamber. A pressure groove is formed in the wall of the slot on the suction side of the vane. The pressure groove is supplied with oil by means of a passage directly connecting the groove with the oil sump whereby a bias force is applied to the vane to partially offset the unbalanced lateral force on the vane portion extending into the cylinder bore.

12 Claims, 7 Drawing Figures

ROTARY COMPRESSOR WITH VANE SLOT PRESSURE GROOVE

BACKGROUND OF THE INVENTION

This invention relates to hermetic rotary compressors for compressing a compressible gas such as a refrigerant. In particular this invention relates to an improvement in such compressors whereby a biasing force is applied to the suction side of the compressor sliding vane to offset lateral forces on the vane extension generated by the pressure differential in the compression chamber.

Hermetic compressors of the type to which this invention relates and which are used in appliances such as refrigerators, freezers, air-conditioners and the like, generally include a hermetic casing or housing, a compressor cylinder block and an electric drive motor for operating the compressor. The compressor cylinder block includes an axial bore in which is disposed a roller member disposed about an eccentric portion of the crankshaft. The crankshaft may be journalled in one or more bearings such as a main bearing and an outboard bearing. The compressor bearings generally also serve as end plates for the cylinder whereby the bore is formed into a compression chamber within which the roller member revolves. The compressor cylinder also includes an axial slot within which a reciprocable vane is slidably disposed, the end portion of the vane engaging the periphery of the roller to divide the chamber into a high pressure or discharge side and a low pressure or suction side.

In operation, gas is drawn into the suction side of the compression chamber wherein it is compressed and then discharged through a discharge port disposed between the high pressure side of the compressor chamber and the compressor housing. During the operation of such a compressor, especially compressors of relatively large displacement, a considerable side or lateral force is exerted on the vane or, more specifically on the portion of the vane which extends into the compression chamber. These forces result from the high discharge pressure on one face of the vane and the suction pressure on the other face of the vane. This lateral force is transmitted by the vane to the vane slot walls and especially to the cylinder edge of the vane slot wall on the suction side of the vane. The result is a concentration of vane slot wear in that area as well as wear of the vane. It is therefore desired to provide for the reduction of such lateral forces and the attendant vane and vane slot wear. Additionally, due to the exacting tolerances to which the parts of the compressor must be machined, it is desired to provide proper lubrication for the vane to reduce wear and friction forces and thereby extend the life of the compressor.

Numerous arrangements have been provided in the prior art for lubrication of compressor vanes. One such arrangement is disclosed in U.S. patent application Ser. No. 670,307, filed Nov. 13, 1984 and assigned to the assignee of record of the instant application. In this arrangement two grooves are provided respectively in the opposed side walls of the cylinder vane slot. These grooves are connected to an axial bore in the crankshaft by means of a connecting passage in the outboard bearing. The bottom end portion of the crankshaft is provided with an oil pump which is disposed in an oil sump. Oil is drawn upwardly into the crankshaft and is pumped outwardly through the connecting passage into the vane slot grooves. By means of this arrangement a supply of oil under positive pressure is at all times provided to the compressor vane for lubrication thereof. However, since the pressure of the oil in the vane slot grooves is equal on both sides of the vane the forces on the vane generated thereby will cancel each other. The lateral force generated on the vane due to the difference in pressure between the suction and discharge sides of the compressor chamber is therefore not offset by this lubrication arrangement.

Another prior art patent disclosing a lubrication arrangement for a compressor is U.S. Pat. No. 2,883,101. This patent discloses a groove in the compressor vane rather than the vane slot. Oil is pumped upwardly from an oil sump to a point above the compressor cylinder from which it runs downwardly by gravity through an opening in the side of the vane slot and from thence into the vane groove. The vane, as it reciprocates, will deliver oil into the compression chamber by means of the vane groove. This arrangement therefore does not supply oil to the vane groove under positive pressure and does not provide a bias force for offsetting lateral forces on the vane.

U.S. Pat. No. 3,513,476 discloses recognition of the lateral force due to the pressure differential between the high and low pressure gas to which the vane is subjected and the attendant wear of the vane and vane slot. The solution provided for solving this problem is to provide two vane slot grooves, one on each side of the vane, and to asymmetrically offset these grooves with respect to a line which extends perpendicularly to the longitudinal axis of the blade. The groove on the discharge side of the vane is moved toward the bore and the slot on suction side of the vane is moved away from the bore. Oil is provided to the grooves by means of a helical groove in the outer surface of the crankshaft from which the oil flows by gravity over a raised ridge into a perforation and from there into the oil grooves.

Yet another prior art patent disclosing recognition of the lateral pressures on a sliding compressor vane is U.S. Pat. No. 3,813,193. In this patent the solution proposed is to provide four grooves in the vane slot and to connect these grooves respectively to areas of high pressure gas and low pressure gas to balance the lateral forces exerted on the vane.

None of these prior art solutions are completely satisfactory in solving the problem of unbalanced lateral forces on the vane while simultaneously providing lubrication for the vane. What is therefore desired is to provide a very simple, low cost, yet effective solution. It is also desired to provide a biasing force on the suction side of the compressor vane while at the same time lubricating the vane. It is furthermore desired to generate such a biasing force which is relatively constant.

SUMMARY OF THE INVENTION

The present invention overcomes the disadvantages of the above described prior art rotary compressors by providing an improved rotary compressor therefor. The compressor of the present invention includes a high side housing, an oil sump in the housing, a cylinder including a vane slot, and a vane reciprocably slidably received therein. A groove is provided in the vane slot wall on the suction side of the vane. This groove is directly connected by means of a connecting passage to the oil sump. Since the groove is located such that, due to leakage past the vane, the groove will be at substantially the same pressure as the suction side of the compression chamber, oil will be drawn into the groove from the oil sump due to the high pressure in the housing which causes oil to flow from the sump through the connecting passage into the oil groove. The pressurized oil will exert hydraulic pressure on the vane, thereby partly offsetting the lateral forces on the vane extension due to the gas pressure differential. Furthermore, the oil will aid in lubricating the vane and will also seal the vane in the vane slot, thereby reducing leakage, vane slot and vane wear and improving the efficiency of the compressor by the reduction of friction forces. The compressor may be manufactured with either a vertical crankshaft or horizontal crankshaft. The only difference between these two arrangements is that the connecting passage for supplying oil to the vane slot oil groove is arranged to pass radially through the end plate in the horizontal crankshaft arrangement, and axially through the end plate in the vertical crankshaft arrangement.

An advantage of the present invention is the reduction in the unbalanced forces on the vane of a rotary hermetic compressor and the resultant reduction in vane wear and vane slot wear.

Another advantage of the invention is the simplicity and effectiveness of the construction whereby oil is supplied to the vane slot pressure groove directly from the oil sump.

A further advantage of the instant invention is that a supply of oil is always available in the sump for supplying oil to the vane slot groove.

The invention, in one form thereof, comprises a rotary hermetic compressor including a housing, an oil sump in the housing, a rotatable crankshaft, a cylinder and a radial slot in the wall of the cylinder. A vane is reciprocably slidably received in the slot and means is disposed in the bore of the cylinder and is operatively connected to the crankshaft for compressing a gas in the bore. The means is also provided for discharging the compressed gas to the housing. The vane divides the bore into a high pressure chamber and a suction chamber. Means is provided for applying a force to the suction side of the vane comprising a single cavity in the wall of the slot of the suction side of the vane, the cavity communicating with the suction volume of the bore by way of leakage. A connecting passage is provided for supplying oil directly from the oil sump to the cavity.

The invention, in one form thereof, further provides a rotary hermetic compressor including a housing, an oil sump in the housing, a crankshaft, a bearing for journalling the crankshaft, and a pump associated with the crankshaft for lubricating the bearing. The cylinder includes a compression chamber and a sliding vane slidably received in an axial slot in the wall of the cylinder, the vane is reciprocated by operation of the crankshaft, and has an end thereof extending into the compression chamber for compressing a refrigerant therein. An end plate is provided for forming an end wall of the compression chamber. The cylinder is interposed between the bearing and the end plate. An axial groove is provided in the one wall of the vane slot which is on the suction side of the vane. The groove extends axially to the respective faces of the cylinder. The end plate and the bearing cover the end openings of the groove whereby the vane, the end plate, the bearing and the groove form a closed pressure cavity adjacent the vane. A passageway directly connects the pressure cavity with the oil sump whereby oil fills the cavity and provides a lateral bias force on the suction side of the vane.

The present invention, in one form thereof, still further provides a method for providing a lateral biasing force on the suction side of a sliding vane of a rotary hermetic compressor. The compressor includes a housing an oil sump in the housing, a cylinder having a bore and a vane slot therein. A vane is slidably received in the slot and an end plate and bearing are respectively disposed adjacent opposite end faces of the cylinder. Means is provided in the bore for compressing a gas therein. The vane divides the bore into respective high and low pressure chambers. The method comprises providing a first groove in the wall of the vane slot, the wall being on the suction side of the vane, then discharging high pressure gas from the bore into the housing, and providing a passage directly connecting the groove to the sump, whereby oil is drawn into the groove from the sump and provides the biasing force on the suction side of the vane.

It is an object of the present invention to provide a compressor with a vane slot pressure groove to provide a bias force on the vane to offset the lateral forces on the vane extension and to reduce wear of the vane and vane slot.

It is another object of the present invention to provide a compressor wherein oil under positive pressure is supplied to the suction side of the vane to offset unbalanced lateral forces on the vane.

Still another object of the present invention is to provide oil under positive pressure to the vane of a compressor for the sealing and lubrication thereof.

Yet another object of the present invention is to provide a compressor including a vane with a simple yet effective vane lubrication arrangement.

BRIEF DESCRIPTION OF THE DRAWINGS

The above mentioned and other features and objects of the invention and the manner of obtaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

Figure 2:
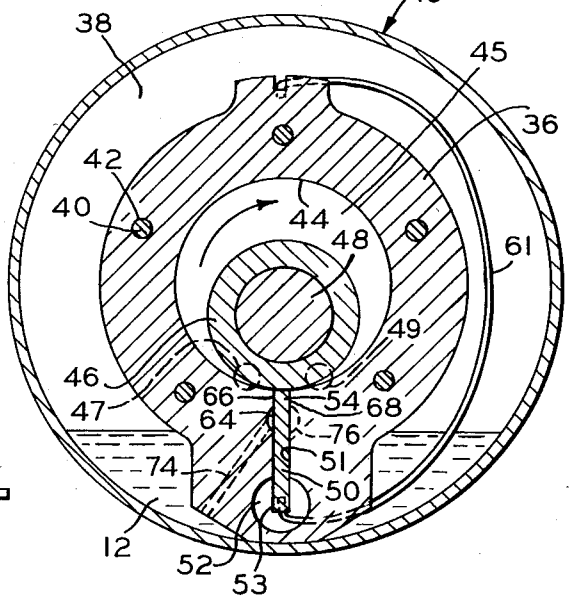
FIG. 2 is a cross-sectional view of the compressor taken along line 2—2 of FIG. 1.
Figure 1:
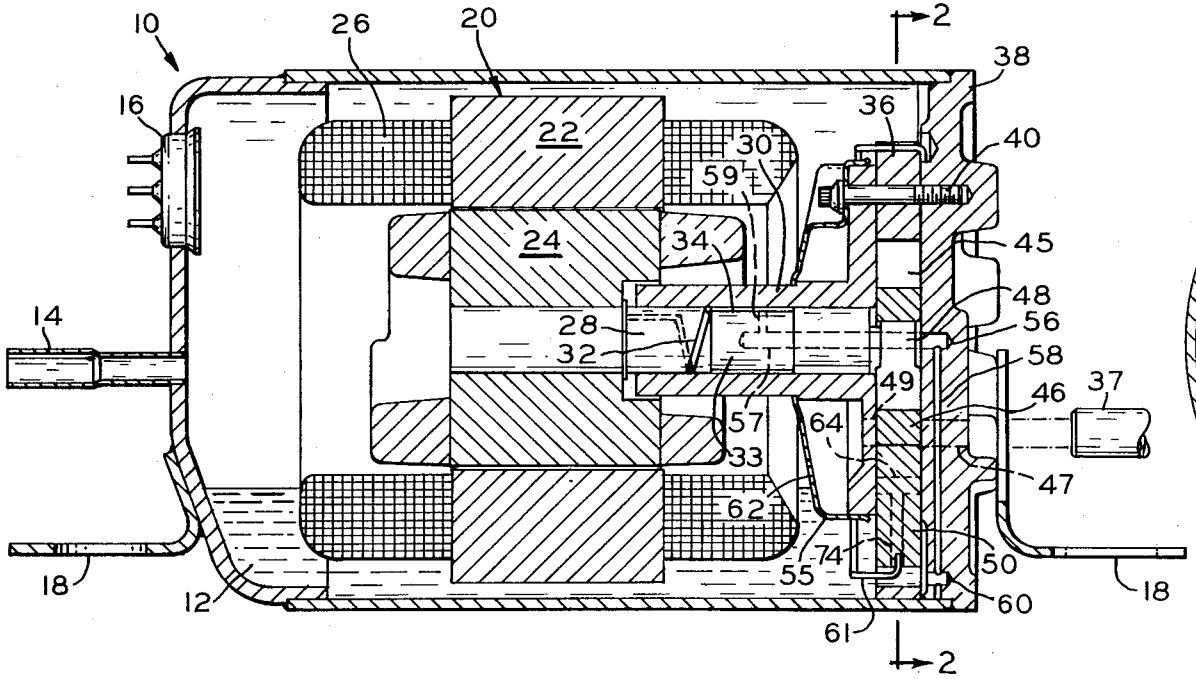
FIG. 1 is an elevational view, in cross-section, of a horizontal crankshaft rotary compressor incorporating the present invention.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Referring to FIGS. 1–4 there is disclosed a horizontal axis compressor including a housing 10 having an oil sump 12 therein. A discharge line 14 is shown connected to an end portion of housing 10. Electrical connector 16 is also shown secured to housing 10. Mounting brackets 18 are provided for mounting the compressor. A motor 20 is provided inside the compressor housing 10 having a stator 22 including stator windings 26 and a rotor 24. Rotor 24 is secured to a crankshaft 28 by any conventional means such as by heat shrinking or a force fit. Crankshaft 28 is journalled in a main bearing 30. Crankshaft 28 also includes a helical groove 32 in its outside surface and furthermore includes a portion 33 of smaller outside diameter to form with the inner surface of bearing 28 an annular chamber 34. Helical groove 32 and annular chamber 34 are used for lubricating the compressor bearings as further explained hereinafter. It should also be understood that annular chamber 34 may be eliminated by providing a continuous helical groove in the outside surface of the crankshaft rather than by forming a portion 33 of smaller outside diameter.

A compressor cylinder 36 is secured to an outboard thrust plate or end plate 38 by means of bolts 40, five of which are provided, as best seen in FIG. 2. A suction tube 37 is provided to supply refrigerant gas to compressor cylinder 36. Bolts 40 are disposed in apertures 42 in cylinder 36 and secure together main bearing 30, cylinder 36 and end plate 38. Cylinder 36 is therefore sandwiched between bearing 30 and end plate 38. It should also be noted that end plate 38 functions as both the end portion of housing 10 and as the outboard thrust plate for cylinder 36, as further disclosed in copending patent application Ser. No. 791,325 filed on even date herewith and assigned to the assignee of the present invention.

Figure 3:
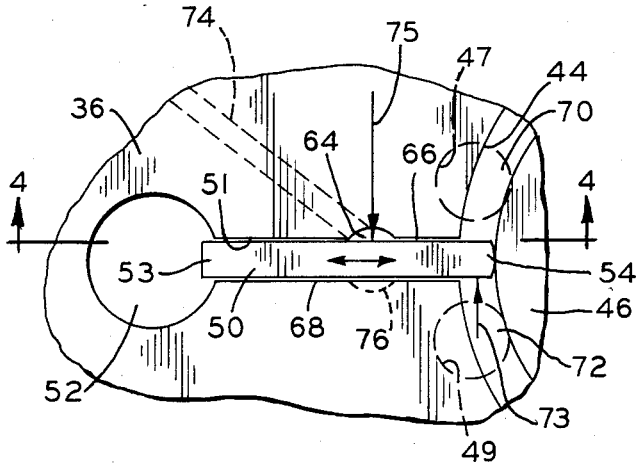
FIG. 3 is an enlarged, broken away, cross-sectional view of the vane and vane slot of FIG. 2.
Figure 4:
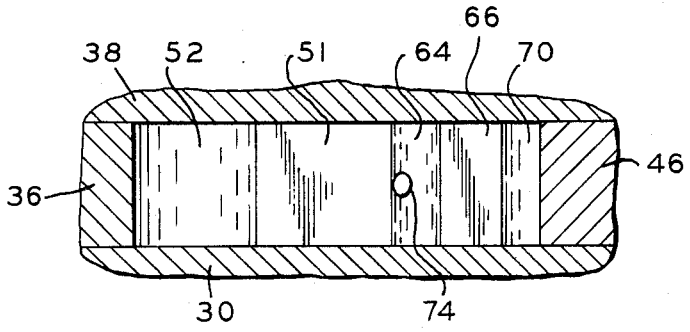
FIG. 4 is an enlarged, broken away, cross-sectional view of the suction side of the vane slot of FIG. 3 taken along line 4—4.

Cylinder 36 includes a bore 44 in which is rotatably disposed a roller 46 which surrounds an eccentric portion 48 of crankshaft 28. A suction aperture 47 in end plate 38 is connected to suction tube 37 for supplying refrigerant to bore 44. A discharge passage 49 is provided in main bearing 30 to conduct compressed refrigerant from bore 44 into housing 10. Cylinder 36 also includes a radial vane slot 51 in which is slidably disposed a vane 50 for reciprocable sliding action as best seen in FIG. 3. Cylinder 36 also includes a bore 52 to provide clearance for the end 53 of blade 50. The opposite end 54 of blade 50 is in contact with roller 46 so that, as roller 46 gyrates and revolves around bore 44 by virtue of the gyrating movement of eccentric 48, the point of contact of roller 46 with the wall of bore 44 will rotate around compressor chamber 45. Because of this action the suction volume in chamber 45 will increase as the contact point of roller 46 passes the position of FIG. 2 and the discharge volume of chamber 45 will decrease, thus compressing the gas in the discharge volume. FIG. 3 illustrates the position of roller 46 at a point where the gas in the discharge volume of chamber 45 is partly compressed.

Referring further to FIGS. 1–4, the compressor also includes a discharge muffler 55 secured to main bearing 30. Thus, discharge gas passes from passage 49 into muffler 55 and from there through apertures 62 into housing 10. Furthermore, end plate 38 is provided with an axial bore 56, a radial passage 58 and a further axial bore 60. In addition crankshaft 28 is provided with an axial bore 57 which is positioned to align with bore 56 and a radial passage 59. Thus, by means of this circuit of passages, as crankshaft 28 rotates, the pumping action due to the rotation of helical groove 32 will cause annular chamber 34 to be a low pressure region, thereby drawing oil from sump 12 through passages 60, 58, 56, 57 and 59 into annular chamber 34 and helical groove 32. This pumping action will supply oil to the crankshaft bearings. Discharge muffler 55 is provided with a plurality of openings 62 for the discharge of compressed gas into the housing 10 of the compressor. Furthermore vane spring 61 provides a bias force to the back of the vane 50.

As best seen in FIG. 3, end 54 of blade 50 which extends into the compressor bore is exposed to unbalanced lateral forces since the discharge side 72 of the bore is at higher pressure than the suction side 70 of the bore. This difference in pressure across the vane generates a bias force on the end of vane 50 which extends into the bore as shown by arrow 73. A pressure groove 64 is provided in the suction side 66 of vane slot 51. Groove 64 is located closer to bore 44 than to bore 52, since the lateral force on blade 50 is concentrated in the area closely adjacent bore 44. This groove 64 is connected by means of a passage 74 in cylinder 36 to oil sump 12. Groove 64, due to its proximity to the suction side 70 of the compression chamber, will be at substantially the same pressure as the suction side 70 of chamber 45. However, housing 10 and oil sump 12 of the compressor will be substantially at discharge pressure because of the discharge of compressed gas there into from discharge muffler 55. This difference in pressure between oil sump 12 and groove 64 will cause oil to flow through connecting passage 74 into groove 64. The pressurized oil in groove 64 will generate hydraulic pressure on vane 50 which will offset the force represented by arrow 73. The offsetting force is shown by arrow 75. Groove 64 is in effect a pocket or cavity as the end openings of groove 64 are closed off by means of bearing 30 and end plate 38. Therefore there will be no oil flow through groove 64 and only a slight amount of oil will escape from oil groove 64. As blade 50 reciprocates the oil in oil groove 64 will lubricate the suction side 70 of the blade 50.

One method of fabricating groove 64 is to drill or mill an axial circular hole through the cylinder whereby semicircular grooves 76 in discharge side 68 of the vane slot 51 and groove 64 in suction side 66 of vane slot 51 are formed. The end openings of groove 76 are closed off by means of bearing 30 and end plate 38. Therefore groove 76 forms a blind hole or cavity and serves no purpose other than to simplify the manufacture of groove 64.

Figure 5:
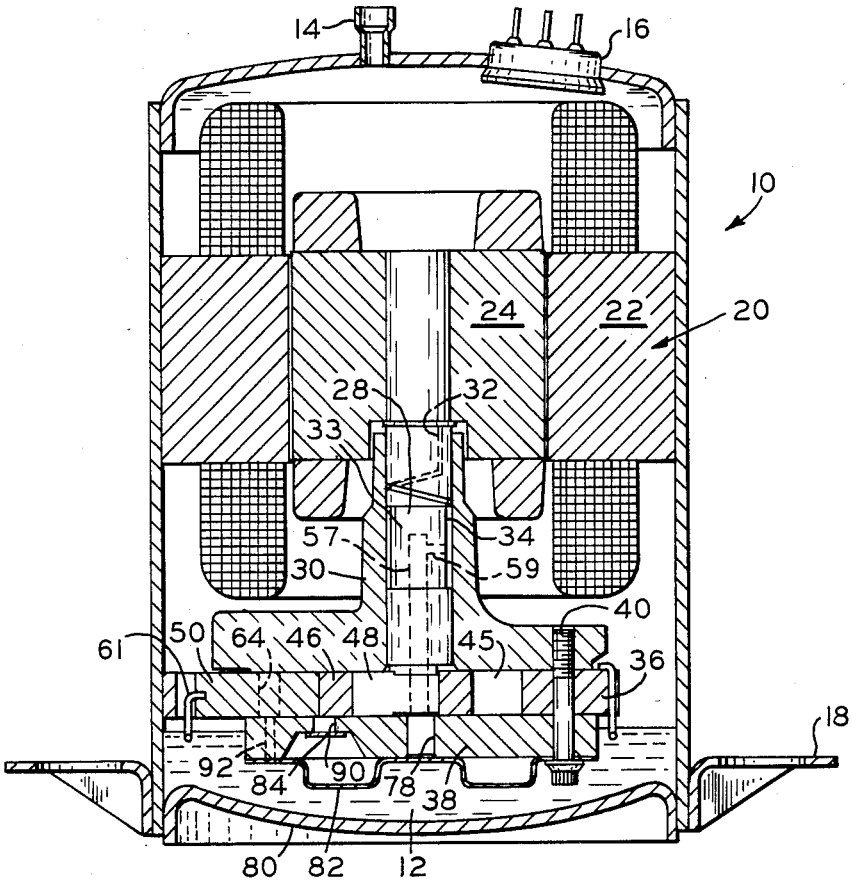
FIG. 5 is an elevational view in cross-section of a vertical crankshaft compressor incorporating the present invention.
Figure 6:
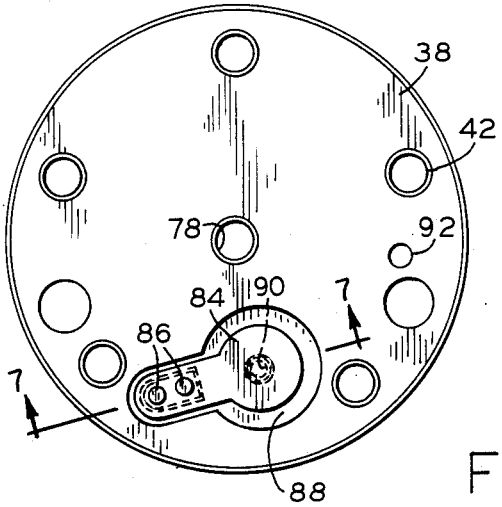
FIG. 6 is a plan view of the outboard thrust plate of FIG. 5.
Figure 7:
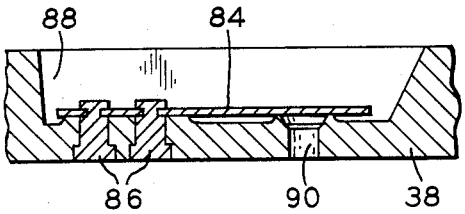
FIG. 7 is an enlarged, broken away, sectional view of the discharge valve and discharge cavity in the outboard thrust plate taken along line 7—7 of FIG. 6.

Referring now to FIGS. 5, 6 and 7, an alternate embodiment of the invention is shown. A vertical crankshaft compressor is provided including motor 20 and a vertical crankshaft 28. crankshaft 28 again includes a helical groove 32, annular chamber 34, axial bore 57 and radial oil passage 59. End plate 38 includes an axial bore 78 for conducting oil from sump 12 through axial bore 57 and radial passage 59 to annular chamber 34. From chamber 34 oil is conducted through helical groove 32 to lubricate the bearings of compressor crankshaft 28. It should be noted that end plate 38 in this configuration does not form part of housing 10. Rather outboard thrust plate 38 only serves as the end plate for compressor cylinder 36. Compressor housing 10 includes a separate shell end portion 80 forming the bottom of the compressor housing wherein the oil sump 12 is located.

End plate 38 has secured thereto a discharge muffler 82. Furthermore, end plate 38 includes a discharge cavity 88 within which is disposed a discharge valve 84 and which is secured to end plate 38 by means of suitable fasteners such as rivets 86. Compressed gas will be discharged from compression chamber 45 through an axial bore 90 in end plate 38, past valve 84 into the housing of the compressor. Pressure groove 64 is again provided on the suction side 66 of vane slot 51 of cylinder 36 and is supplied with oil by means of a small axial passage 92 provided in end plate 38 and which is located to align with slot 64. Therefore, since the gas in the housing 10 is under pressure, oil will be forced through passage 92 from sump 12 into cavity 64 to generate a bias force on the suction side of blade 50 and furthermore to lubricate blade 50. It should also be appreciated that, as in the horizontal crankshaft compressor embodiment of FIGS. 1–4, pressure groove 64 may be provided by forming an axial bore through the vane slot thereby forming semicircular grooves on both sides 66 and 68 of vane slot 51. Groove 76 thus formed on the discharge side of vane slot 51 will be a blind hole as it will be closed off by bearing end 30 and end thrust plate 38.

While this invention has been described as having a preferred design it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. The method for providing a lateral biasing force on only the suction side of a sliding vane of a rotary hermetic compressor, said compressor including a housing, an oil sump in said housing, a cylinder having a bore and a vane slot therein, a vane slidably received in said slot, said vane having a suction side and a discharge side, an end plate and bearing respectively disposed adjacent opposite end faces of said cylinder, means in said bore for compressing a gas therein, said vane and said compressing means dividing said bore into respective high and low pressure chambers, said method comprising:

providing a first groove in a wall of said vane slot on the suction side of said vane;

discharging high pressure gas from said bore into said housing, thereby exerting pressure on the oil in said oil sump;

directly connecting said groove to said sump with a passage, whereby oil is supplied to only said groove from said sump by the relative pressure difference between said housing and said groove, said oil providing a biasing force on only the suction side of said vane.

2. The method according to claim 1 wherein said groove is provided by forming an axial circular bore in said vane slot, said bore forming both said first groove and a second axial groove in the respective side walls of said vane slot, said bearing and end plate covering the end openings of said respective first and second grooves.

3. The method according to claim 1 wherein said first groove is located close to said bore whereby said groove is at substantially the suction pressure of said bore

4. A rotary hermetic compressor including a housing, an oil sump in said housing, a rotatable crankshaft, a cylinder, a radial slot in the wall of said cylinder, a vane reciprocably slidably received in said slot, means disposed in a bore of said cylinder and operatively connected to said crankshaft for compressing a gas in said bore, means for discharging said compressed gas into said housing, said vane and said compressing means dividing said bore into a high pressure chamber and a suction chamber, said vane having a suction side and a discharge side, means for applying a force to only the suction side of said vane comprising:

a single only oil filled cavity in a wall of said slot on only the suction side of said vane, said cavity communicating with the suction volume of said bore;

passage means directly connecting said cavity to said sump whereby pressurized oil will be forced into said cavity by the relative pressure difference between said housing and said cavity.

5. The compressor according to claim 4 including an end plate and a crankshaft bearing, said cylinder disposed between said end plate and bearing, said cavity comprising an axial through groove, the ends of said groove being open to the respective end faces of said cylinder, the open ends of said groove being covered respectively by said bearing and end plate.

6. The compressor according to claim 4 wherein said cavity is spaced closer to said bore than to the outside perimeter of said cylinder whereby the cavity is at substantially suction pressure.

7. The compressor according to claim 4 wherein said crankshaft is horizontally disposed in said housing, said connecting passage means comprising a radial passage in said cylinder.

8. The compressor according to claim 4 wherein said crankshaft is vertically disposed in said housing, said connecting passage comprising an axial through passage in said end plate, said through passage being aligned with said groove.

9. The compressor according to claim 4 wherein said crankshaft includes an oil pumping means for supplying oil to the crankshaft bearings.

10. A rotary hermetic compressor including a housing, an oil sump in said housing, a crankshaft, bearing means for journalling said crankshaft, pump means associated with said crankshaft for lubricating the bearings of said crankshaft, a cylinder including a compression chamber, means including a sliding vane operated by said crankshaft, said vane having a suction side and a discharge side and having an end thereof extending into said compression chamber for compressing refrigerant therein, means for discharging compressed refrigerant into said housing, a radial slot in the wall of said cylinder for slidably receiving said vane, end plate means for forming an end wall for said compression chamber, said cylinder interposed between said bearing means and said end plate means, means for applying a biasing force to only the suction side of said vane comprising:

a single axial groove in a wall of said vane slot, on the suction side of said vane, said groove extending axially to the respective faces of said cylinder, said end plate means and said bearing means covering the end openings of said groove, whereby said vane, said end plate, said bearing, and said groove form a single closed pressure cavity adjacent said vane;

passage means directly connecting only said single pressure cavity with said oil sump, whereby the relative pressure difference between said housing and said cavity forces oil from said sump into only said pressure cavity and thereby provides a lateral bias force on only the suction side of said vane.

11. The compressor according to claim 7 wherein said crankshaft is vertically disposed in said housing and said connecting passage means comprises an axial through passage in said end plate, said passage being aligned with said groove.

12. The compressor according to claim 10 wherein said crankshaft is horizontally disposed in said housing and said connecting passage means comprises a radial passage in said cylinder.

* * * * *

UNITED STATES PATENT AND TRADEMARK OFFICE

CERTIFICATE OF CORRECTION

PATENT NO. : 4,629,403

DATED : December 16, 1986

INVENTOR(S) : Mark W. Wood

It is certified that error appears in the above-identified patent and that said Letters Patent is hereby corrected as shown below:

Claim 11, Col. 9, line 7, change "7" to --10--.

Signed and Sealed this

Twenty-fourth Day of March, 1987

*Attest:*

DONALD J. QUIGG

*Attesting Officer*

*Commissioner of Patents and Trademarks*